United States Patent [19]

Lazaroff

[11] 3,945,543

[45] Mar. 23, 1976

[54] GARMENT HANGER

[76] Inventor: Gary G. Lazaroff, c/o Clean Coverall Supply Co., 1317 S. 7th St., St. Louis, Mo. 63104

[22] Filed: Nov. 29, 1974

[21] Appl. No.: 528,330

[52] U.S. Cl. ..... 223/88; 211/119

[51] Int. Cl.[2] ..... A47J 51/097

[58] Field of Search ..... 223/85, 88, 91, 95; 211/113, 119

[56] References Cited

UNITED STATES PATENTS

| | | | |
|---|---|---|---|
| 1,910,629 | 5/1933 | Navarte | 223/88 |
| 1,970,009 | 8/1934 | Linnemann | 223/88 |
| 2,025,114 | 12/1935 | Legus | 223/88 |

FOREIGN PATENTS OR APPLICATIONS

| | | | |
|---|---|---|---|
| 128,362 | 7/1948 | Australia | 223/88 |
| 518,254 | 2/1940 | United Kingdom | 223/88 |

*Primary Examiner*—George H. Krizmanich
*Attorney, Agent, or Firm*—Cohn, Powell & Hind

[57] ABSTRACT

A garment hanger includes a wire frame formed into a lower member, a pair of upper members and an intermediate hook. The lower member is provided with upwardly extending lugs spaced to accommodate the waistband loops of pairs of trousers of various sizes so that the trousers can be suspended from the hanger and conveyed through laundering apparatus.

1 Claim, 4 Drawing Figures

FIG. 1
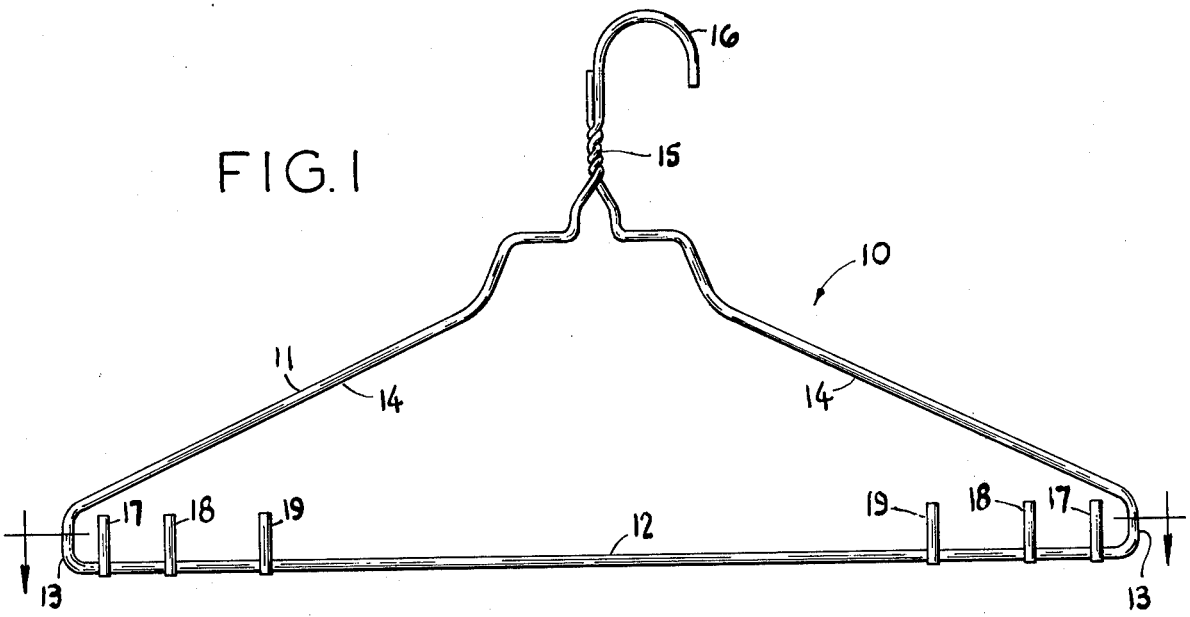
FIG. 2
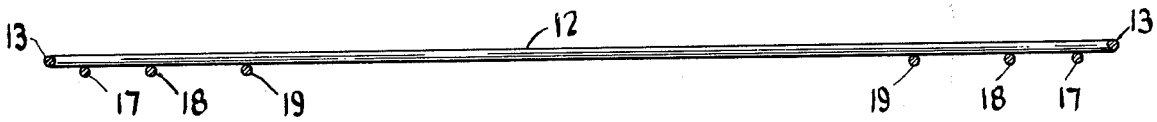
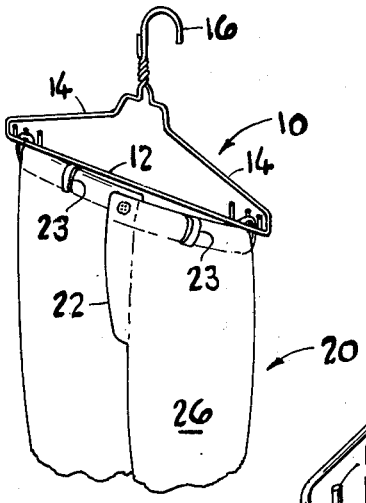
FIG. 4
FIG. 3
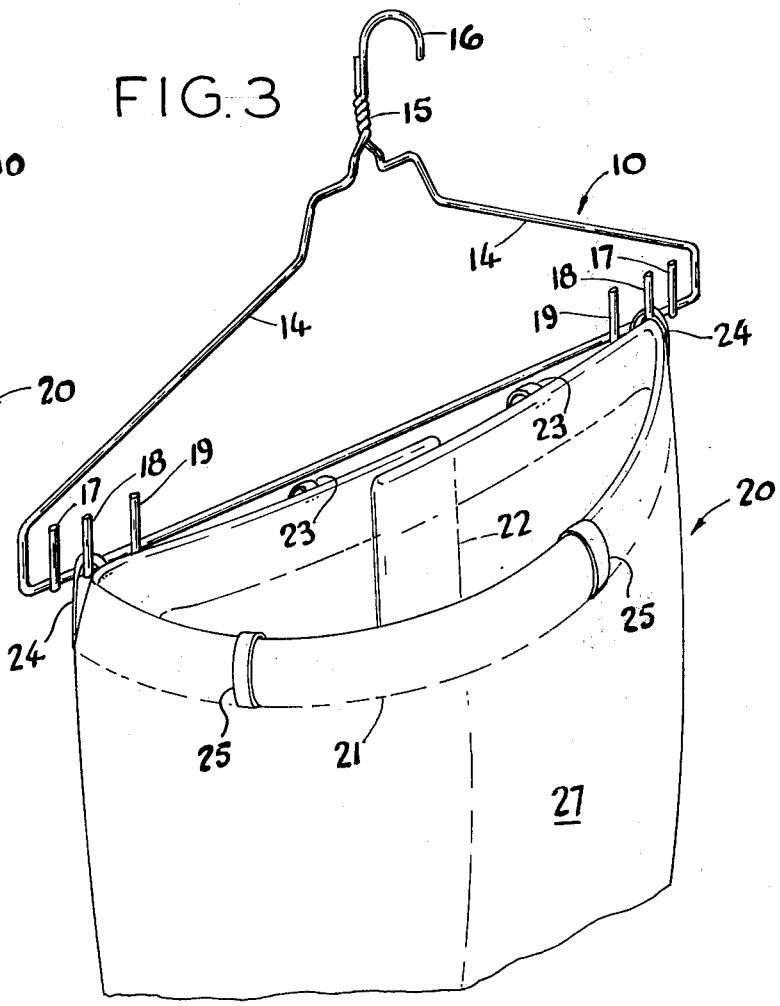

GARMENT HANGER

BACKGROUND OF THE INVENTION

This invention relates to an improved garment hanger for supporting trousers during laundering.

Conventional methods of laundering garments require that the garment be suspended from a hanger while it is passed through the washing and drying zones of the laundering system. The laundering apparatus is somewhat similar to automatic car wash systems and works most efficiently when the garments are suspended in such a manner that folding, which produces overlapping of the fabric, is substantially eliminated. In this way the detergent spray used can reach all portions of the garment during the cleaning process.

The suspension of trousers provides a particular problem because of the difficulty of finding a hanger which is capable of solving the fold problem and is adapted to suit trousers of various sizes, but is yet inexpensive to manufacture. It will be particularly appreciated that it is exceedingly important for the hanger to be adapted so that the trousers can be hung thereon, preferably from the waistband, with a minimum of delay: obviously, therefore, it is necessary to provide a hanger which does not require relative movement of its parts before the trousers can be hung. In addition, it is important to provide a hanger which is strongly constructed.

Conventional hangers, formed into an open frame are relatively strong. unfortunately, they are quite unsuitable for laundering purposes because the trousers must be folded. This is a time consuming process and moreover results in four plies of material.

Hangers have been devised having a cantilevered lower arm which cuts down the hanging time to some extent but results in a relatively weak hanger.

Other attempts have also been made to solve this combination of problems. For example, U.S. Pat. No. 2,288,551 discloses a hanger which is relatively simply constructed to provide twin longitudinal arms which slidingly receive the waistband loops. However, these arms must be interlocked at their ends by the operator. U.S. Pat. No. 2,496,088 discloses a hanger having end hooks which carry trousers by engaging the waistband loops. However, the hanger is quite complicated and adjustment of the hook spacing must be made by relative movement of hanger parts. U.S. Pat. No. 2,692,711 discloses a hanger which aims at suspending trousers by the waistband loops. However, although there are no moving parts on this hanger the trousers must be installed in at least two steps which is time consuming for the operator.

The present hanger solves these and related problems in a manner not disclosed in the known art.

SUMMARY OF THE INVENTION

It is an important object of this invention to provide a garment hanger which can readily support trousers of various waistband sizes by utilizing the waistband loops and which does not utilize relatively moving hanger parts.

Another important object is to provide a hanger from which trousers can be suspended with the waistband uppermost with a minimum of movement on the part of the operator.

An important object of this invention is to provide a hanger which includes a substantially peripheral open frame and an intermediate hook formed from a single length of wire, the frame including a lower member, and to provide a plurality of upwardly projecting elements integrally formed with the lower member and disposed in spaced relation on each side of said hook.

Another object is to form the projecting elements from relatively short wire lengths of the same diameter as the frame which are welded to the lower frame portion said lengths being disposed in a different plane from the open frame.

Another object is to provide the projecting elements which are spaced in mirror image of each other relative to the midpoint of the lower frame member and to provide at least three elements on each side of said midpoint disposed at different spaced intervals from each other.

It is an object to provide a garment hanger of greatly simplified construction which can be inexpensively manufactured and easily used by anyone.

BRIEF DESCRIPTION OF THE DRAWING

FIG. 1 is an elevational view of the garment hanger;

FIG. 2 is a sectional plan view taken on line 2—2 of FIG. 1;

FIG. 3 is a perspective view from the front showing the hanger in use; and

FIG. 4 is a similar view from the rear.

DESCRIPTION OF THE PREFERRED EMBODIMENT

Referring now by characters of reference to the drawing and first to FIGS. 1 and 3, it will be understood that the garment hanger, which is generally indicated by numeral 10, is adapted to hang a pair of trousers 20 in an upright position in such a manner that the trousers can be passed by a conveyor (not shown) through a washing and drying process.

The hanger 10 includes an open frame 11 formed from a single length of wire and providing a lower member 12, side members 13 and inwardly directed upper members 14 having ends which are intertwined 15 and formed into a hook 16. Importantly, the hanger lower member 12 is provided with a plurality of vertical lugs 17, 18 and 19 constituting upwardly projecting elements. In the preferred embodiment said elements are provided by relatively short lengths of the same diameter wire as the frame 11 and are integrally constructed with said lower member 12 by being welded to the front face thereof. This structural arrangement of parts provides that the lugs are, as shown in FIG. 2, disposed in a different plane from said open wire frame 11.

The use of the hanger 10 is clearly shown by reference to FIGS. 3 and 4, which illustrate the front and rear views respectively of the hanger 10 carrying a pair of trousers 20. The trousers 20 are conventional in that they include a waistband 21 having a plurality of belt loops attached thereto, namely front loops 23, side loops 24 and rear loops 25. Said loops 23–25 are spaced about the waistband 21 in substantially symmetrical relation relative to the fly overlap 22. The side loops 24 are used to hang the trousers 20 over the hanger lugs having a spacing most closely corresponding to the spacing of said loops 24 when the fly overlap 22 is closed. In order for the trousers 20 to hang properly during the laundering process it is desirable that one portion of the waistband 21 be taut to minimize folding. In the embodiment shown the distance between the loops 24 on waistband 21 at the front of the trousers 20 is somewhat less than the distance between loops 24 at the rear. Thus, the trousers 20 are hung with the front portion 26 taut and the rear portion 27 relatively slack. This arrangement avoids overlapping of the fabric and permits the cleaning detergent to be directed into the interior of the trousers 20.

It will be readily understood that the hanger lugs 17–19 provide a means by which the trousers can be hung in a single movement by the operator without loss of time. This is achieved by simply holding the trousers by loops 24, with the front portion of the waistband taut, and placing the loops over the lugs most nearly corresponding in spacing to the loops 24. The spacing between lugs 17 and 18, in the preferred embodiment, is different from that between lugs 18 and 19, which permits a greater adjustment potential than would otherwise be possible, it being not essential that the weight of the trousers be distributed exactly evenly on the hanger 10. Thus, a relatively small number of lugs can accommodate a fairly wide range of different trouser size. Further, the welding of the lugs 17 through 20 to the front face of the lower member 12 renders the emplacement of the loops easier by positioning said lugs forwardly of the frame 11.

I claim as my invention:

1. A garment hanger for hanging trousers from the waistband loops said hanger comprising:

a. a substantially peripheral frame including a lower member and opposed upper members, formed from a single length of wire said lower member being substantially straight, b. a hook integrally formed with said upper members, c. a plurality of upwardly projecting elements welded to the face of said lower frame member and disposed in spaced relation on each side of said hook for receiving selected waistband loops, d. said projecting elements being independently formed from single, straight wire lengths of the same diameter as said frame, and e. said projecting elements being disposed in a plane parallel to the plane of said frame and said projecting elements being spaced in mirror image of each other relative to the midpoint of the lower frame member and including at least three elements on each side disposed at different intervals.

* * * * *